United States Patent [19]

Matsuo

[11] 4,239,206

[45] Dec. 16, 1980

[54] SHEET FEEDING APPARATUS

[76] Inventor: Masaharu Matsuo, No. 17-3, Higashi Komagata 3-chome, Sumida-ku, Tokyo, Japan

[21] Appl. No.: 10,539

[22] Filed: Feb. 9, 1979

[30] Foreign Application Priority Data

| | | | |
|---|---|---|---|
| Feb. 27, 1978 | [JP] | Japan | 53-20888 |
| Feb. 27, 1978 | [JP] | Japan | 53-20889 |
| Mar. 1, 1978 | [JP] | Japan | 53-22039 |

[51] Int. Cl.[3] ..... B65H 5/16; B65H 9/04

[52] U.S. Cl. ..... 271/271; 198/726; 271/240; 271/248; 271/273

[58] Field of Search ..... 271/271, 233, 248, 250, 271/251, 35, 139, 140, 198, 273, 274; 198/726, 728, 732

[56] References Cited

U.S. PATENT DOCUMENTS

| | | | |
|---|---|---|---|
| 1,789,504 | 1/1931 | Uline | 198/726 |
| 2,191,330 | 2/1940 | Straw | 271/271 X |
| 2,570,030 | 10/1951 | Forster | 198/732 |
| 2,669,342 | 2/1954 | Neal | 198/726 X |
| 3,690,647 | 9/1972 | Matsuo | 271/251 |
| 3,741,536 | 6/1973 | Anderson | 271/274 |

*Primary Examiner*—Bruce H. Stoner, Jr.
*Attorney, Agent, or Firm*—Toren, McGeady and Stanger

[57] ABSTRACT

In sheet feeding apparatus of the type disclosed in U.S. Pat. No. 3,690,647, at least one conveyor chain extending in a closed loop is moved on supporting structure in a path having two reversing portions arcuate about respective axes of curvature, a feeding portion substantially straight and parallel to the plane of intended sheet movement, and a return portion, the feeding and return portions connecting the reversing portions. The axes of curvature of the reversing portions are obliquely or perpendicularly transverse to the plane of sheet movement. The conveyor chain has at least one sheet engaging dog fastened to a corresponding link of the chain in such a manner that the dog moves in the plane of sheet movement while the associated chain link moves in the feeding portion of its path, and the dog moves about the axes of curvature in respective arcs of smaller radii of curvature than those of the reversing path portions when the associated chain link moves in the latter.

7 Claims, 15 Drawing Figures

SHEET FEEDING APPARATUS

This invention relates to sheet feeding apparatus, and particularly to a conveyor system for sequentially feeding individual pieces of sheet material to processing equipment, such as a rotary die cutting machine.

In its more specific aspects, the invention is concerned with improvements in the apparatus disclosed in my earlier U.S. Pat. No. 3,690,647 in which a sheet of cardboard or the like is fed to a rotary cutting machine on a supporting bed of idling guide rollers by a feeding dog on an endless conveyor chain one strand of which travels in a practically straight path under the plane of sheet movement between reversing sprockets rotating about horizontal axes. The feed dog projects upward from the chain into the plane of sheet movement and its sheet engaging portion moves through an arc of greater radius of curvature than the chain while the chain travels over the reversing sprockets. The linear speed of the sheet engaging dog portion is thus equal to the chain speed in the straight portion of the chain path, but higher than the chain speed while moving around the reversing sprockets.

While feeding apparatus of my earlier invention operates very successfully under most conditions, difficulties have arisen in the feeding of soft and relatively pliable sheets. The feeding dog engages the transverse rear edge of the sheet, and must maintain engagement until the front end of the sheet is securely grasped in the nip between the cylinders of the cutting machine or other driven, sheet engaging elements of the machine which move at a constant speed preferably synchronized with the speed of the conveyor chain. If the feeding dog of my earlier invention remains engaged with the sheet being fed while the dog travels in an arc about the axis of the reversing sprocket near the cutting machine, the sheet buckles and may not resume its original shape when ultimately released by the dog.

It has now been found that this problem can be avoided in feeding apparatus of the type described by making the reversing portions of the path of the conveyor chain or analogous conveying member arcuate about respective axes of curvature which intersect the plane of movement of the conveyed sheet. At least one sheet engaging dog is fastened to a part of the conveying member for movement in that plane while the fastened part of the conveying member moves in a straight feeding portion of its path, the dog being fastened to the conveying member part in such a manner that the dog moves about the afore-mentioned axes of curvature in respective arcs having smaller radii of curvature than the reversing portions of the path of the conveying member.

Other features, additional objects, and many of the attendant advantages of this invention will readily be appreciated as the same becomes better understood from the following detailed description of preferred embodiments when considered in connection with the appended drawing in which.

Figure 1:
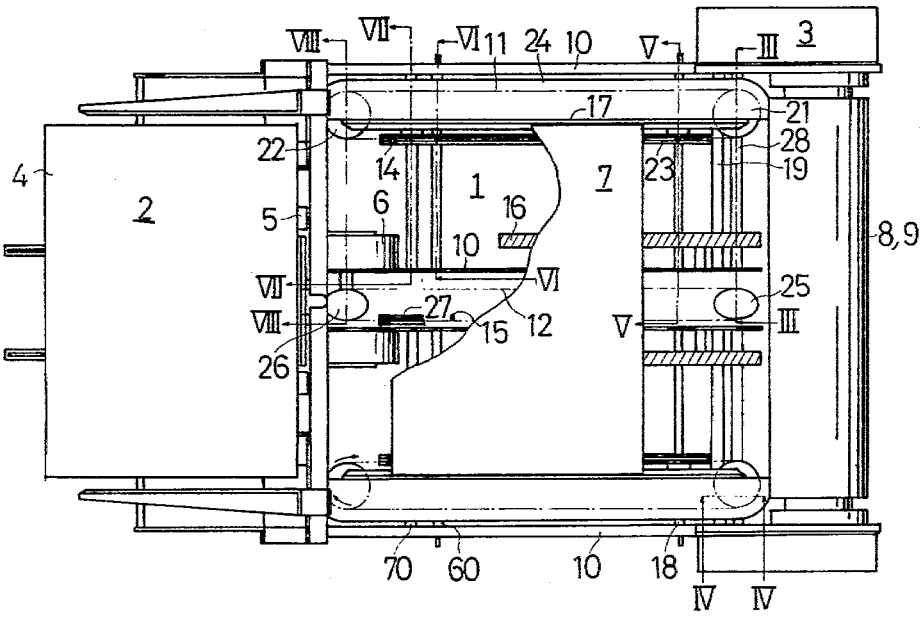
FIG. 1 is a top plan view of a rotary die cutting machine supplied with cardboard blanks by a conveyor system of the invention.
Figure 9:
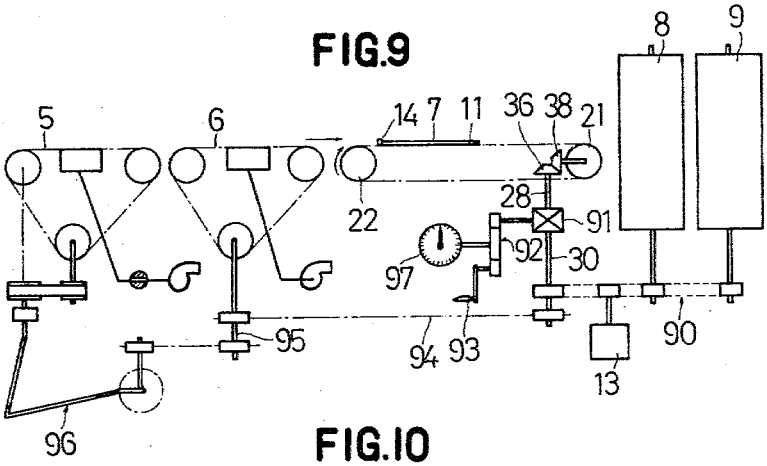
Figure 10:
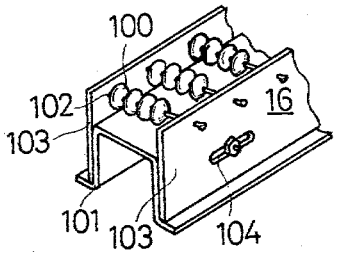
Figure 11:
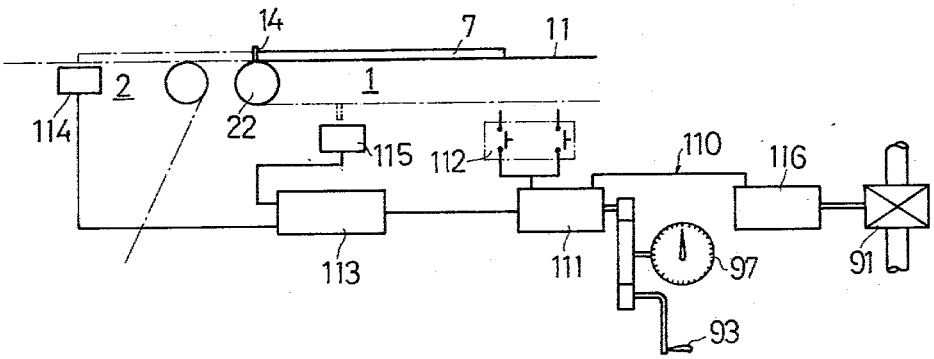
Figure 12:
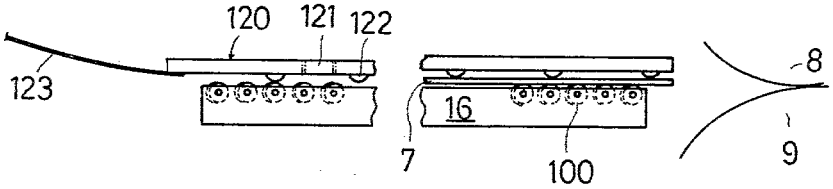
Figure 13:
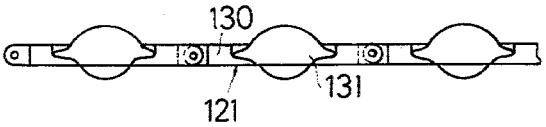
Figure 14:
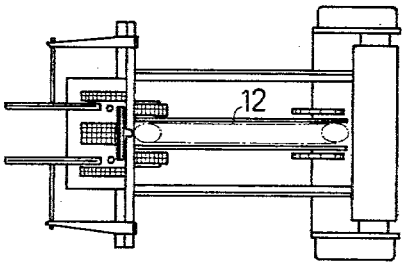
Figure 15:
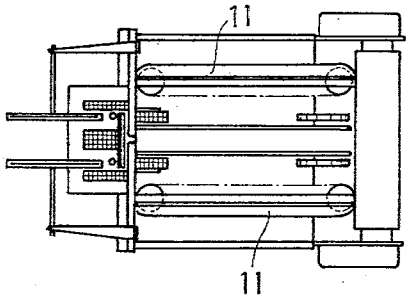

FIG. 9 diagrammatically illustrates the drive system for the apparatus of FIG. 1;

FIG. 10 is a perspective view of a portion of the apparatus of FIG. 1;

FIG. 11 illustrates a partial modification of the drive system of FIG. 9;

FIG. 12 shows supplemental elements for the conveyor system of FIG. 1 in side elevation on a larger scale;

FIG. 13 illustrates a portion of the device of FIG. 12 on a further enlarged scale; and FIGS. 14 and 15 illustrate additional modifications of the apparatus of FIG. 1 on a smaller scale in simplified representation.

Figure 2:
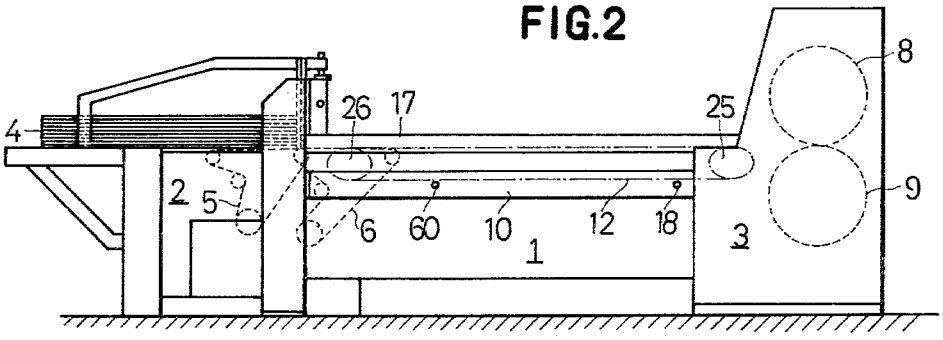
FIG. 2 shows the apparatus of FIG. 1 in simplified side elevation.

Referring initially to FIGS. 1 and 2, there is shown sheet processing machinery of the invention including a chain conveyor system 1 which connects a suction belt conveyor 2 to a rotary die cutting machine 3. Individual cardboard sheets 7 are sequentially transferred from a stack 4 of superimposed sheets by an intermittently operating suction belt 5 of the conveyor 2 to a continuously running suction belt 6 of the conveyor 2, and are deposited by the latter on the chain conveyor system 1 for delivery to the nip of cylinders 8, 9 of the die cutting machine 3, not illustrated in detail. The several operating devices are mounted on a common supporting frame 10.

The chain conveyor system 1 includes two lateral link chains 11 and a central link chain 12. One of several, spaced driving dogs 15 on the central chain 12 is seen in FIG. 1, and a corresponding dog 14 on one of the chains 11. The sheet 7 is conveyed by the chains 11, 12 on carriers 16 between lateral guides 17 which may be adjusted to the width of the conveyed sheets 7 by cylindrical connecting bars 18, 19, 60, 70 as will be described in more detail hereinbelow.

The chains 11 and 12 are trained in closed loops over respective driven front sprockets 21, 25 near the cylinders 8, 9 and rear idler sprockets 22, 26. The lateral chains 11 travel in partly straight, horizontal paths defined by guide channels 23 mounted on the guides 17, and similar channels 27 guide the central chain 12. A cover 24 on each lateral guide 17 partly envelops the associated chain 11 in the return portion of its path. The front sprockets 21, 25 are driven by a common drive shaft 28.

Figure 3:
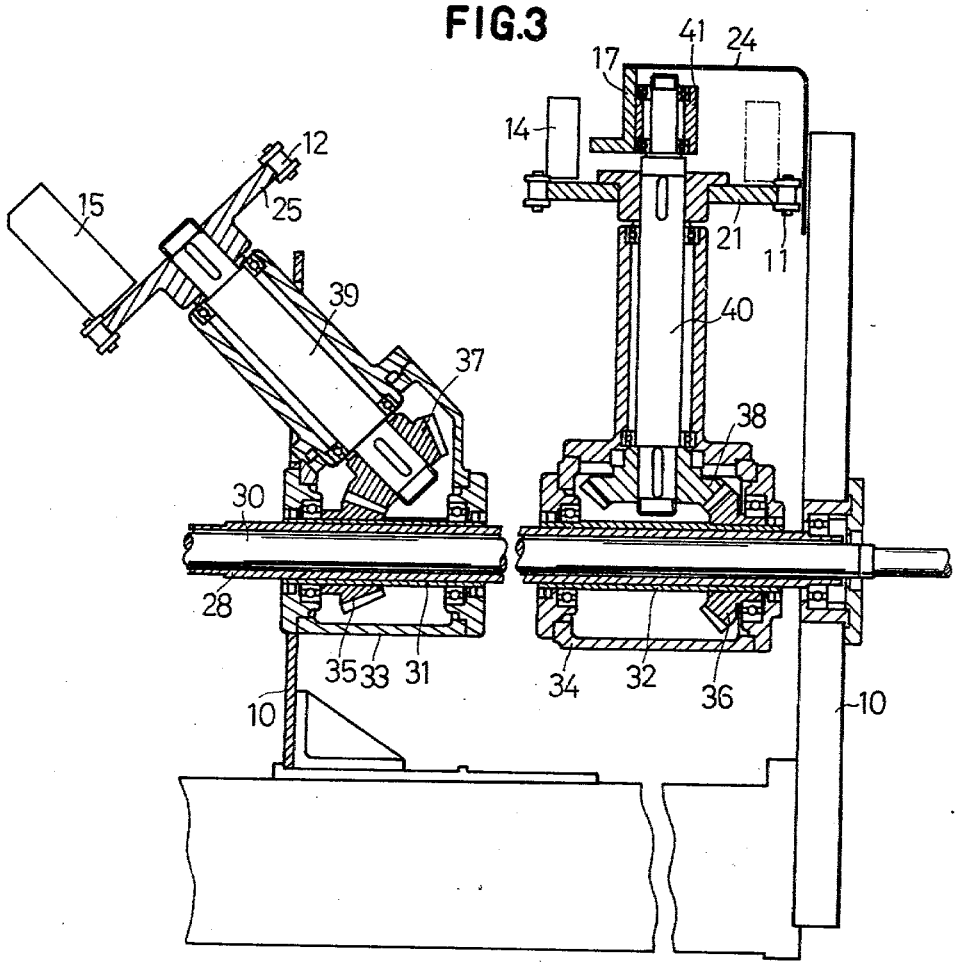
FIG. 3 is a sectional view taken along the line 3—3 in FIG. 1.

As is better seen in FIG. 3, a main conveyor shaft 30 coaxially carries the tubular shaft 28 which is adjustably coupled to the main shaft 30, as will presently be described. Sleeves 31, 32 are splined to the shaft 28 for joint rotation and are axially slidable on the shaft 28 while being axially secured in respective gear boxes 33, 34. Bevel gears 35, 36 on the sleeves 31, 32 mesh with bevel gears 37, 38 on respective shaft 39, 40 which carry the driven front sprockets 25, 21. The shaft 39 is inclined at an angle of about 45° relative to the horizontal plane of sheet movement so that the chain 12 travels in a plane similarly inclined. Each dog 15 is attached to a link of the chain 12 and travels on the inside of the semicircle in which the chain moves about the reversing sprocket 25 in a path whose radius of curvature is shorter than that of the chain path. The upper end of the shaft 40 is journaled in a bearing 41 on the lateral guide 17 for rotation about an axis practically perpendicular to the plane of movement of the conveyed sheet 7. Each dog 14 travels about the axis of the shaft 40 on the driven sprocket 21 in an arc whose radius of curvature is shorter than that of the path in which each lateral chain 11 rounds the shaft on the sprocket 21. It will be understood that the other sprocket 21 is mounted between an associated lateral sheet guide 17 and a gear box in a manner analogous to the showing of FIG. 3.

Figure 4:
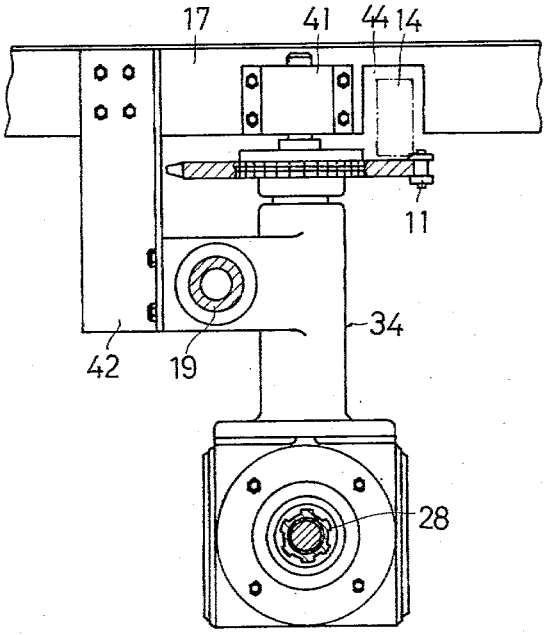
FIG. 4 is a view partly in section taken along the line 4—4 in FIG. 1.
Figure 5:
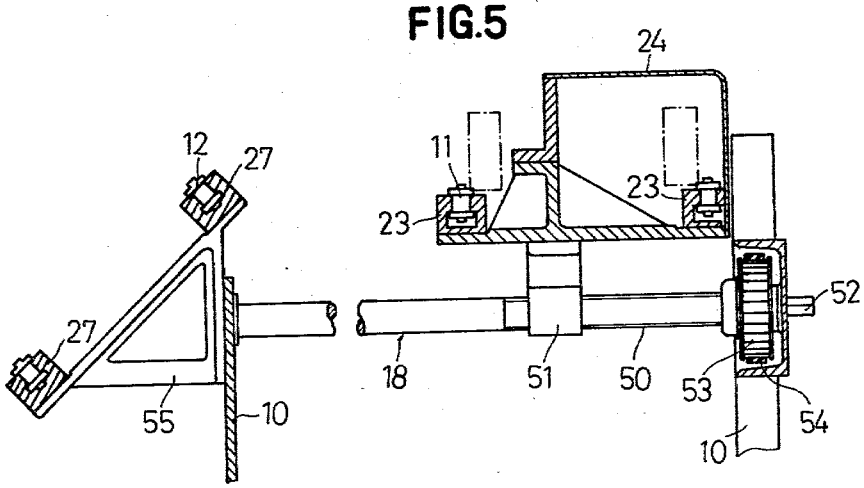
FIG. 5 is a sectional view taken along the line 5—5 in FIG. 1.

As is shown in FIG. 4, the gear box 34 is slidably mounted on the bar 19 and is fixedly attached to a longitudinally terminal part of the lateral guide 17 by a bracket 42. A recess 44 in the lateral guide 17 permits movement of the dogs 14 transverse to the direction of sheet movement. While traveling substantially parallel to that direction, the chain 11 is guided in channels 23 on respective flanges of the guide 17, as is seen in FIG. 5, the guide 17 having the approximate cross-sectional shape of an inverted T. The cover 24 protects the chain 11 while it moves from the drive sprocket 21 to the idler sprocket 22. FIG. 5 also shows the guide channels 27 for the chain 12 which are supported on the frame 10 by a bracket 55.

Figure 6:
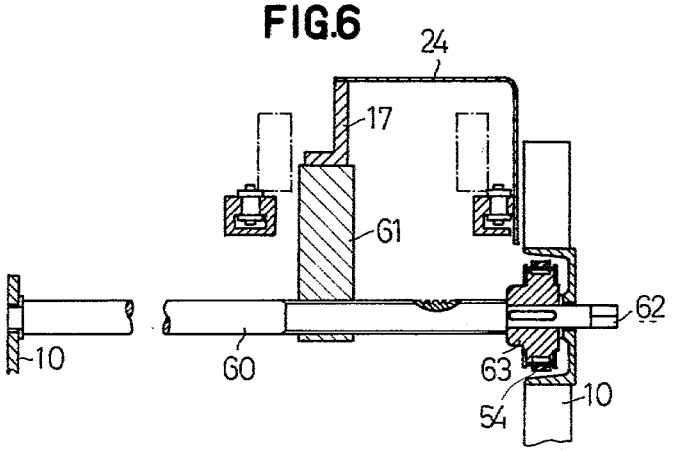
FIG. 6 is a sectional view taken along the line 6—6 in FIG. 1.
Figure 7:
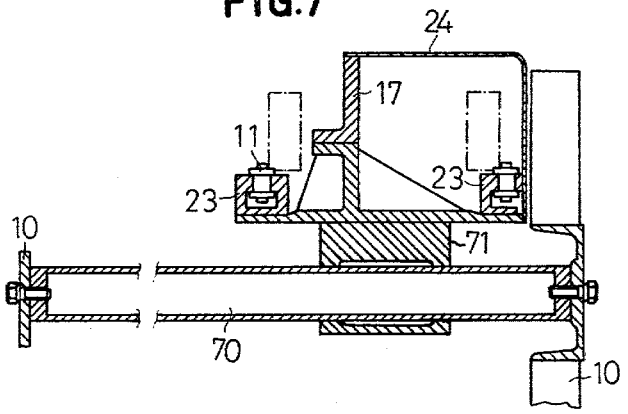
FIG. 7 is a sectional view taken along the line 7—7 in FIG. 1.

The bar 18 is journaled in the frame 10 and carries threads 50. A bracket 51 carrying the lateral guide 17 moves on the threads 50 when the accessible square end 52 of the bar 18 is turned manually by means of a mating crank or wrench to shift the lateral guide 17 and the chain 11 associated therewith relative to the chain 12 and the other guide 17. A sprocket 53 fixed on the bar 18 and a ribbed belt 54 transmit the rotation of the bar 18 to a sprocket 63 on the bar 60, as is best seen in FIG. 6. A threaded portion of the bar 60 carries a bracket 61 fixed to a portion of the lateral guide 17 longitudinally spaced from the portion seen in FIG. 5. The square end 62 of the bar 60 may be turned instead of the end 52 on the bar 50. Yet another longitudinal portion of the guide 17 slides freely on the bar 70, shown in FIG. 7, by means of yet another bracket 71.

Figure 8:
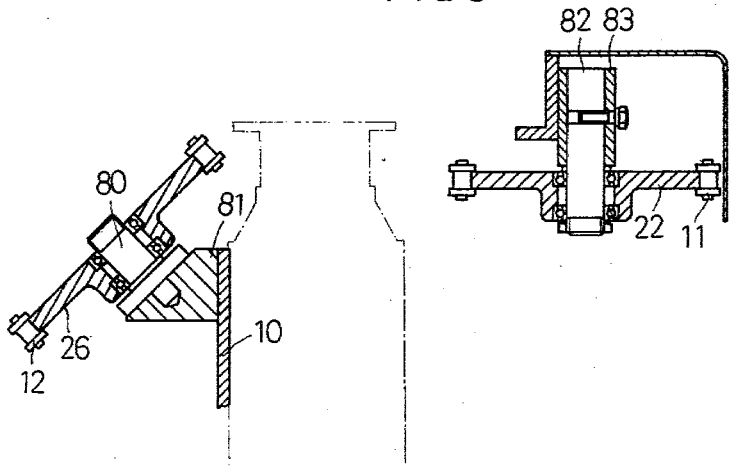
FIG. 8 is a sectional view taken along the line 8—8 in FIG. 1.

As is seen in FIG. 8 the idler sprocket 26 for reversing the movement of the central chain 12 is rotatably supported on a stub shaft 80 inclined 45° to the plane of sheet movement and mounted on the frame 10 by means of a bracket 81 that may be shifted in the direction of sheet travel on the conveyor system 1 for taking up slack in the chain 12, the adjusting mechanism, conventional in itself, not being shown. Similarly, an upright stub shaft 82 rotatably supporting the idler sprocket 22 for each chain 11 is mounted in a sleeve 83 which also may be shifted in the direction of sheet movement in a conventional manner, not shown.

As is shown in FIG. 9, a single electric motor 13 drives the entire apparatus described so far. A transmission belt 90 connects the motor 13 to the cylinders 8, 9 of the die cutting machine and also to the main conveyor shaft 30. The latter is coupled to the drive shaft 28 for the sprocket 21 and other sprockets not shown in FIG. 9 by a coupling 91 which turns the two shafts relative to each other in a known manner when a crank 93 of an adjusting mechanism 92 is turned, thereby shifting the dog 14 while the conveyor 5 stands still, the relative angular position of the shafts 28, 30 being shown on a dial indicator 97.

Another transmission belt 94 connects the main shaft 30 with a drive shaft 95 for continuously operating the suction belt 6 of the conveyor 2 as long as the motor 13 is energized. A crank mechanism 96 drives from the shaft 95 and equipped with a one-way clutch intermittently operates the suction belt 5 of the conveyor 2. The suction boxes and fans associated with the belts 5, 6 are represented in FIG. 9 by conventional symbols, but are too well known in this context to require more detailed illustration for description.

As described more fully in my afore-mentioned earlier patent and partly shown in FIG. 10, the sheet 7 is supported on carriers 16 including guide rollers 100 mounted in box frames 101 on the supporting frame 10 between the chains 11, 12. The guide rollers 100 have the approximate shape of double cones and are rotatably strung on shafts 102 axially secured in oversized bores of flanges 103 of the frame 101. A slot 104 in one flange 103 permits the slotted flange to be moved relative to the remainder of the box frame 101 so as to vary the angular positions of the shafts 102 to suit specific requirements. As is known from my earlier patent, the rollers 100 gently shift the moving sheet 7 laterally into guiding engagement with a lateral guide 17 for precise alignment with the cutting dies, not shown, on the cylinders 8, 9.

During operation of the apparatus, the intermittently driven suction belt 5 sequentially pulls individual sheets 7 from the bottom of the stack 4 and transfers them to the belt 6 which moves continuously at the same speed as the chains 11, 12. As each sheet 7 is transferred to the chain conveyor system 1, its rear edge is engaged immediately by the dogs 14, 15 whose positions are set by means of the coupling 91 and which travel about the idlers 22, 26 in arcs of shorter radius than the arcs traveled by the chains about axes of curvature inclined relative to the plane of sheet movement at angles of 90° and 45° respectively. The portions of the dogs 14, 15 which engage the sheet 7 move at the same speed, identical with the linear chain speed, at all times.

As the dogs 14, 15 travel about the drive sprockets 21, 25 in arcs of shorter radius than the associated chains 11, 12, they do not push the sheet 7 into the nip of the cylinders 8, 9 at a speed higher than the circumferential speed of the cylinders, and deformation or buckling of the sheets entering the cutting machine is safely avoided.

Because the coupling 91 and the associated adjusting mechanism 92 illustrated in FIG. 9 are not readily accessible, it is preferred to operate the clutch remotely by means of a synchro-system 110 as is shown in FIG. 11. The synchro receiver 116 is located adjacent the coupling for operating the same, but the associated transmitter 111 which may be operated manually by means of the crank 93 may be located elsewhere together with the dial indicator 97. The transmitter 111 also may be controlled by a manually operated switch 112 more convenient than the crank 93 or by an automatic control device 113 equipped with sensors 114, 115 arranged at the suction belt conveyor 2 and adjacent the path of one of the dogs 14, 15 for setting the position of the dog to meet the rear edge of a sheet 7 sensed by the sensor 114 as soon as the sheet is transferred to the conveyor system 1. The sheet 7 moves continuously, and there is no relative movement between the sheet and the dogs 14, 15 in the feeding direction so that even very thin and weak sheets are not damaged by sudden dog engagement.

FIG. 12 shows a supplemental sheet guide 120 which may be arranged above each of the carriers 16 to maintain engagement of the travelling sheet with the rollers 100. The body 121 of the supplemental guide 120 consists of two link chains 130, better seen in FIG. 13 whose link pins are horizontal and transverse to the direction of sheet movement. Cages 131 fastened between the two chains 130 hold balls 122 which roll on top of the sheet 7, but are prevented from moving with the sheet by flexible strap 123 fastened to the frame in a non-illustrated manner.

The combination of two lateral chains 11 with a central chain 12 is preferred in the conveyor system 1 because of its inherent adaptability to the conveying of sheets 7 greatly varying in size and flexibility. For more limited fields of application, a single central belt 12 may suffice, as is shown in FIG. 14, or two lateral belts 11 without a central belt, as is shown in FIG. 15. Ultimately, and not specifically illustrated, a single lateral belt may be sufficient in an arrangement similar to that described in my earlier patent.

While the invention has been described in its presently most important application to the feeding of cardboard sheets to a rotary die cutting machine, it may be employed to advantage wherever relatively pliable sheet material needs to be fed to processing equipment of any kind in precise alignment with tools of the equipment.

The planes of movement of the chains 11, 12 have been shown to be inclined relative to the plane of sheet movement at angles of 90° and 45° respectively, and such angles are conveniently arranged, but not critical. At least some advantages of this invention are available if the axes of rotation of the several sprockets intersect the plane of sheet movement at virtually any angle.

If one or two lateral chains 11 are provided as is shown in FIGS. 1 and 15, it is preferred that the chains and their associated reversing sprockets are mounted on lateral guides 17 for movement with the same transversely to the direction of sheet movement. The path of the central chain or chains 12 may be fixed relative to the supporting frame 10.

It should be understood, therefore, that the foregoing disclosure relates only to presently preferred embodiments, and that it is intended to cover all changes and modifications of the examples of the invention herein chosen for the purpose of the disclosure which do not constitute departures from the spirit and scope of the invention set forth in the appended claims.

What is claimed is:

1. Sheet feeding apparatus comprising:

(a) a support defining a plane of sheet movement;

(b) an elongated conveying member extending in a closed loop;

(c) drive means on said support for moving said member in a path having two reversing portions arcuate about respective axes of curvature, a feeding portion substantially straight and parallel to said plane, and a return portion, (1) said axes intersecting said plane, (2) said feeding and return portions connecting said reversing portions;

(d) a sheet engaging dog fastened to a part of said conveying member for movement in said plane while said part moves in said feeding portion and for movement about said axes of curvature in respective arcs having smaller radii of curvature than said reversing portions when said part moves in said reversing portions;

(e) guide means on said support for limiting movement of a sheet engaged by said dog transversely relative to the direction of movement of said conveying member in said feeding portion, said guide means having a face elongated in said direction and transverse to said plane, adjusting means for moving said face transversely relative to said direction, and said drive means are secured to said guide means for movement of said feeding and reversing portions with said face.

2. Apparatus as set forth in claim 1, wherein said axes are obliquely inclined relative to said plane.

3. Apparatus as set forth in claim 1, wherein said axes are substantially perpendicular to said plane.

4. Apparatus as set forth in claim 1, wherein said path is fixed relative to said support, said adjusting means including means for moving said face toward and away from said feeding portion of said path.

5. Apparatus as set forth in claim 1, wherein said conveying member is a link chain, said drive means include two sprockets rotatable about said axes of curvature respectively, said link chain is trained over said sprockets, and said dog is fastened to one of the links of said chain on the inside of said loop and projects from said chain in the direction of said axes while said one link is moved in said reversing portions.

6. Sheet feeding apparatus comprising:

(a) a support defining a plane of sheet movement;

(b) an elongated conveying member extending in a closed loop;

(c) drive means on said support for moving said member in a path having two reversing portions arcuate about respective axes of curvature, a feeding portion substantially straight and parallel to said plane, and a return portion, (1) said axes intersecting said plane, (2) said feeding and return portions connecting said reversing portions;

(d) a sheet engaging dog fastened to a part of said conveying member for movement in said plane while said part moves in said feeding portion and for movement about said axes of curvature in respective arcs having smaller radii of curvature than said reversing portions when said part moves in said reversing portions (e) another elongated conveying member extending in a closed loop, said drive means including means for moving said other member in another path having two reversing portions arcuate about respective other axes of curvature, a feeding portion in spaced and parallel relative to the feeding portion of said first-mentioned path, and a return portion, said feeding and return portions of said other path connecting said return portions of the other path, said other axes intersecting said plane at a common angle different from the angles of intersection of said first-mentioned axes with said plane, and another sheet engaging dog fastened to a part of said other member, said dogs being aligned at right angles to said feeding portions during movement of the associated conveying member parts in said feeding portions, and said common angle of inclination is substantially 45°, and the angles of intersection of said first-mentioned axes are substantially 90°.

7. Apparatus as set forth in claim 1, further comprising supplemental sheet guide means, said plane extending horizontally, said sheet guide means including a body portion secured above said plane against movement in the direction of movement of said conveying member in said feeding portion of the path thereof, but freely movable toward and away from said feeding portion in a vertical direction, and rotatable sheet engaging means on said body portion downwardly directed toward said plane.

* * * * *